US005664976A

United States Patent [19]

Mishima et al.

[11] Patent Number: 5,664,976

[45] Date of Patent: Sep. 9, 1997

[54] OUTBOARD MOTOR

[75] Inventors: Shuichi Mishima, Iwata; Atsushi Noda, Hamamatsu; Hidetsugu Shimada, Hamamatsu; Masashi Takayanagi, Hamamatsu; Fumio Matsui, Shizuoka-ken, all of Japan

[73] Assignee: Suzuki Kabushiki Kaisha, Shizuoka-ken, Japan

[21] Appl. No.: 720,746

[22] Filed: Oct. 1, 1996

[30] Foreign Application Priority Data

Dec. 4, 1995 [JP] Japan ..... 7-315273

[51] Int. Cl.[6] ..... B63H 1/15

[52] U.S. Cl. ..... 440/52; 440/88

[58] Field of Search ..... 123/195 P; 440/52, 440/53, 88, 900; 248/640

[56] References Cited

U.S. PATENT DOCUMENTS 5,309,877 5/1994 Shigedomi et al. ..... 123/195 P 5,388,555 2/1995 Shiomi et al. ..... 440/52

5,501,621 3/1996 Shigedomi et al. ..... 440/88

*Primary Examiner*—Edwin L. Swinehart

*Attorney, Agent, or Firm*—Finnegan, Henderson, Farabow, Garrett & Dunner, L.L.P.

[57] ABSTRACT

An outboard motor comprises, in an installed or mounted state, an engine holder, an engine located to an upper portion of the engine holder, a drive shaft housing located to a lower portion of the engine holder for housing a drive shaft extending downward from the engine, and an oil pan formed to the engine holder, the oil pan being provided with a wall section to which steering brackets are secured through upper mounts. A first seal member is disposed at a mating surface portion of an upper surface of the drive shaft housing and a lower surface of the oil pan and a second seal member is disposed at a mating surface of an upper surface of the oil pan and a lower surface of the engine to thereby expose the drive shaft between the first and second seal members.

1 Claim, 7 Drawing Sheets

OUTBOARD MOTOR

BACKGROUND OF THE INVENTION

The present invention relates to an outboard motor having a structure capable of preventing a cooling water from entering an engine and reducing an engine vibration from transferring the vibration to a hull.

FIG. 6 shows an elevational section of an outboard motor having a general structure. Referring to FIG. 6, an outboard motor 1 is provided with an engine holder 3 formed with an oil pan 2, an engine 4 disposed to an upper portion of the engine holder 3 and a drive shaft housing 5 disposed to a lower portion of the engine holder 3, in an installed state of the outboard motor 1.

In the engine 4, a crank shaft 6 is arranged perpendicularly and an upper end portion of a drive shaft 7 is connected to a lower end portion of the crank shaft 6. The drive shaft 7 extends downward inside a shaft pipe 8 formed on the side of the oil pan 2 and a shaft pipe 9 formed inside the drive shaft housing 5, and the drive shaft 7 operates to drive a propeller 11 through a bevel gear and a propeller shaft, not shown, disposed in a gear case 10 arranged to a lower portion of the drive shaft housing 5.

The outboard motor 1 is generally provided with a water-cooling type cooling device, which acts to pump up such as sea water by a water pump disposed to the lower portion of the drive shaft 7 as a cooling water, which is supplied to the respective elements of the engine 4 through a water pipe 13. In order to prevent the water pump 12 from sucking an air in the shaft pipes 8 and 9, a part of the cooling water is over-flowed into the shaft pipe 9 disposed above the water pump 12. Further, the shaft pipe 9 is formed with a hole 14 communicating with an external portion for the purpose of discharging, through the hole 14, the cooing water over-flowed in the shaft pipe at a time when an inner pressure of the shaft pipe increases. A seal member 15 is disposed at a mating surface between the engine 4 and the oil pan 2, i.e. the upper end portion of the shaft pipe 8 and is adapted to prevent the cooling water from invading into the engine 4.

The outboard motor 1 is mounted to a transom 16*a* of a hull 16 through clamp brackets 17 and steering brackets 18, and the steering brackets 18 are mounted to the wall section constituting the oil pan 2 of the engine holder 3. With reference to FIG. 7, a pair of upper mounts 19 are fixed to the wall section of the oil pan 2 through elastic members 20 such as rubber. The upper mounts 19 are disposed so as to sandwich the drive shaft 7 from both sides thereof and the steering brackets 18 are fixed to the upper mounts 19 by means of bolts 21, for example.

According to the structure described above, however, when the seal member 15 disposed to the upper end portion of the shaft pipe is damaged, the cooling water in the shaft pipe invades into the engine, causing a troublesome problem.

Furthermore, since the drive shaft near the upper mounts is positioned inside the shaft pipe, it becomes difficult to take much space or volume for the elastic members because of the location of the shaft pipe. Hence, the vibration of the engine may not be sufficiently absorbed and will be transferred to the hull.

SUMMARY OF THE INVENTION

An object of the present invention is to substantially eliminate defects or drawbacks encountered in the prior art described above and to provide an outboard motor having a structure capable of preventing cooling water from entering an engine unit and also capable of reducing transferring to vibration of an engine to a hull to which the outboard motor is mounted.

This and other objects can be achieved according to the present invention by providing an outboard motor comprising, in an installed state, an engine holder, an engine located to an upper portion of the engine holder, a drive shaft housing located to a lower portion of the engine holder for housing a drive shaft extending downward from the engine, and an oil pan formed to the engine holder, the oil pan being provided with a wall section to which steering brackets are secured through upper mounts, wherein a first seal member is disposed at a mating surface portion of an upper surface of the drive shaft housing and a lower surface of the oil pan and a second seal member is disposed at a mating surface of an upper surface of the oil pan and a lower surface of the engine to expose the drive shaft between the first and second seal members.

According to the structure of the present invention described above, since the first seal member is disposed, in a mounted state of the outboard motor, to the mating surface portion of the upper surface of the drive shaft housing and the lower surface of the oil pan and the second seal member is also disposed to the mating surface of the upper surface of the oil pan and the lower surface of the engine, i.e. crank case thereof, the possibility of invasion of the cooling water in the shaft pipe into the engine can be reduced even if one of these seal members is damaged in its function, and hence, the possibility of damaging the engine can be also reduced.

Furthermore, since the sealing can be made at the upper and lower two portions of the drive shaft, it becomes not necessary to locate the shaft pipe to a side portion of the oil pan, and the drive shaft can be exposed at a portion between the seal members. As a result, it becomes possible to provide a space, between the upper mounts, having a volume larger than that of the conventional structure, whereby elastic members each having a large volume can be disposed between the oil pan and the upper mounts and, hence, the vibration of the engine can be effectively absorbed, reducing the vibration of the engine from being transferred to the hull.

Still furthermore, since it is not necessary to locate the shaft pipe to the side portion of the oil pan, the oil pan can be formed relatively freely in shape and the entire weight of the outboard motor can be effectively reduced.

The nature and further characteristic features of the present invention can be made more clear from the following descriptions made With reference to the accompanying drawings.

DESCRIPTION OF THE PREFERRED EMBODIMENT

One preferred embodiment of the present invention will be described hereunder with reference to the accompanying drawings.

Figure 1:
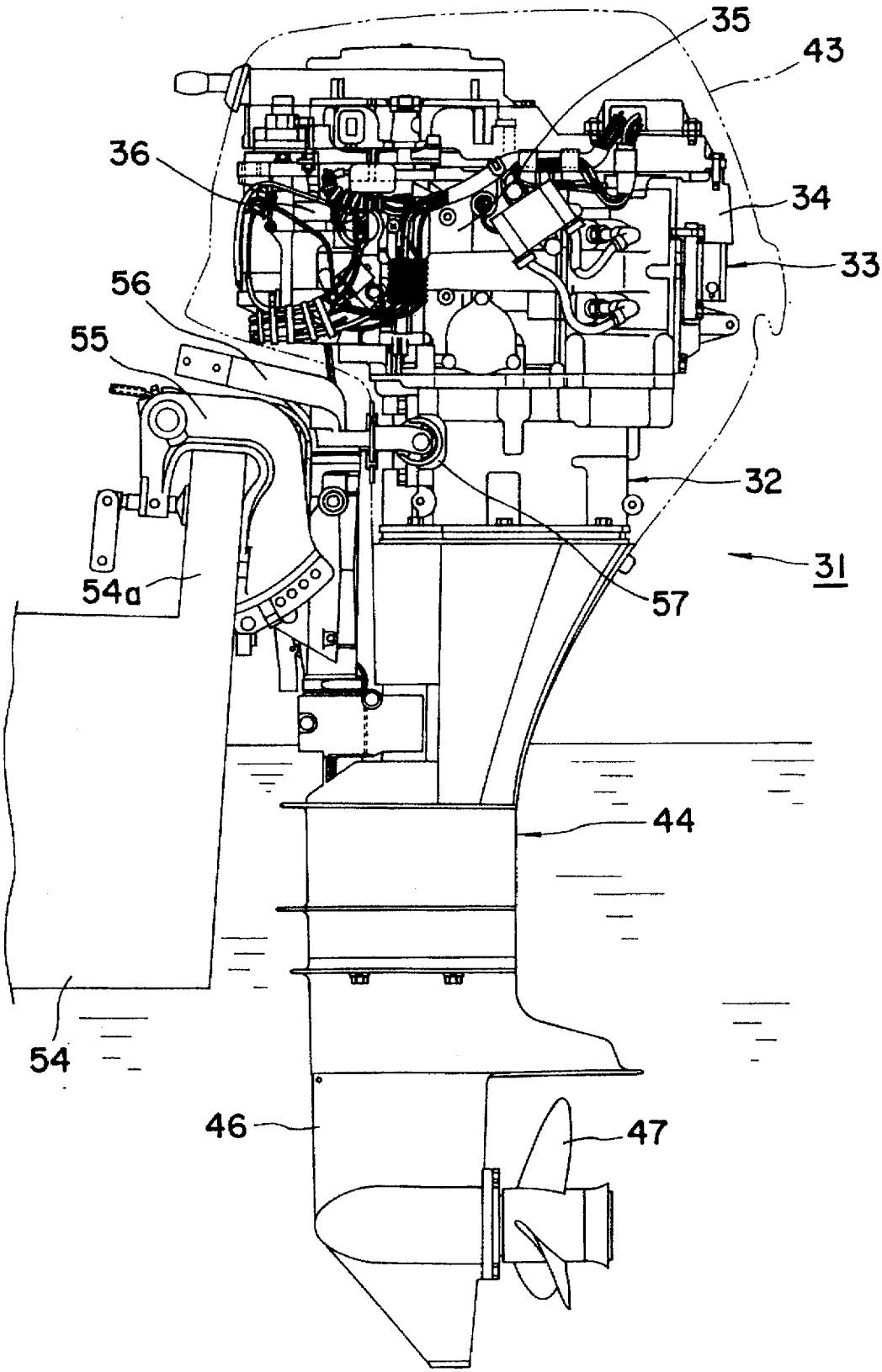
FIG. 1 is a side view of an outboard motor, an engine cover of which is removed, according to one embodiment of the present invention.
Figure 2:
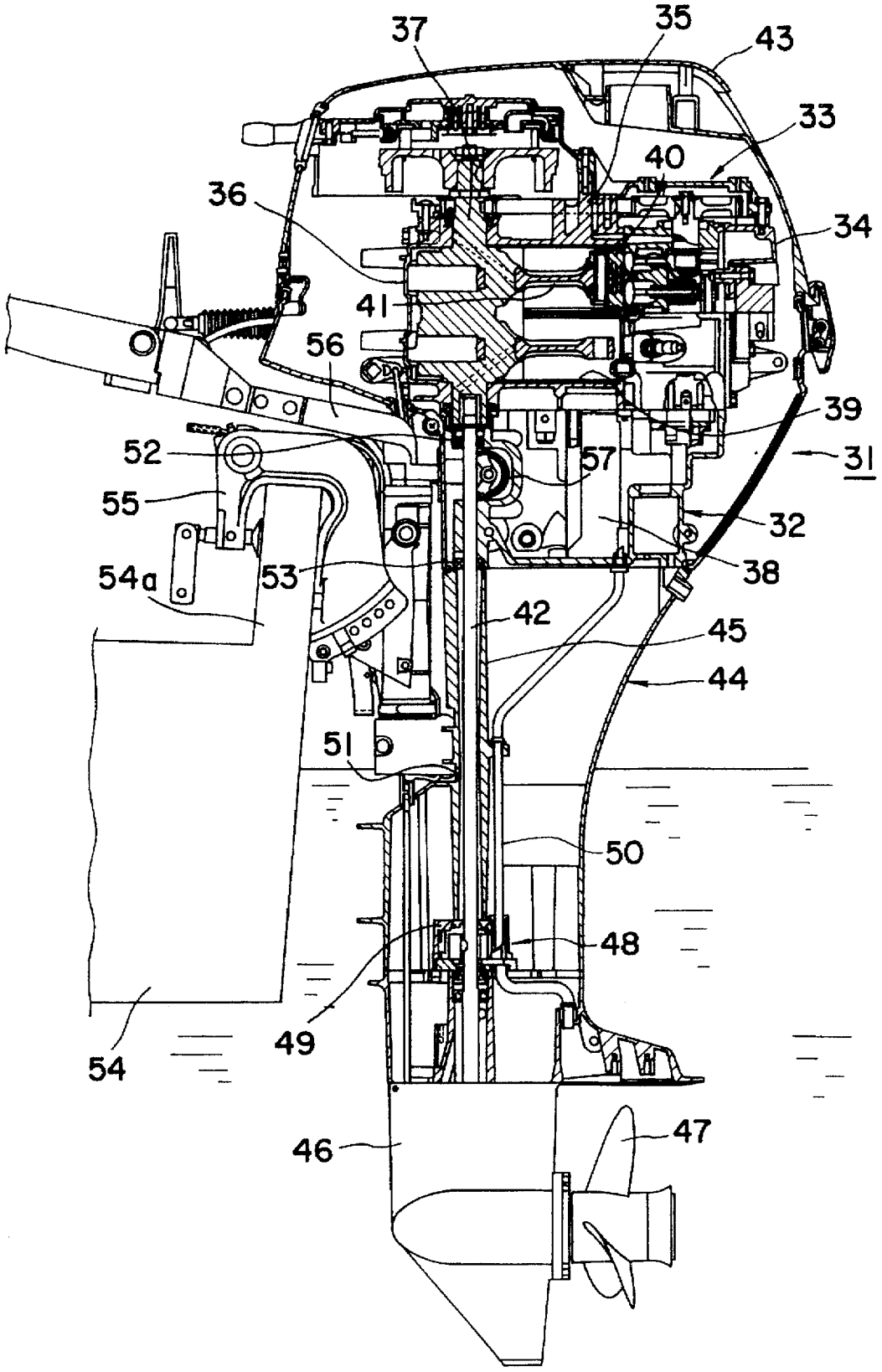
FIG. 2 is an elevational section of the outboard motor of FIG. 1.

Referring to FIGS. 1 and 2, an outboard motor 31 according to the present invention is provided with an engine holder 32 having an upper, as viewed in a mounted state, portion to which an engine 33 is mounted. The engine 33 is, for example, of a water-cooled four-stroke-cycle two-cylinder engine, which is composed of a cylinder head 34, a cylinder block 35, a crank case 36, etc. A crank shaft 37 is perpendicularly arranged in the crank case 36 and an oil pan 38 is formed in the engine holder 32.

Cylinders 39 are disposed in the cylinder block 35 of the engine 33, and a piston 40 is fitted into each of the cylinder 39 to be slidable in a horizontal direction. The piston 40 and a crank shaft 37 is operatively connected through a connection rod 41 to thereby convert the reciprocating stroke of the piston 40 to a rotational motion of the crank shaft 37. The upper end portion of the drive shaft 42 is fitted to the lower end portion of the crank shaft 37 in a spline engaged manner. The engine 33 mounted to the upper portion of the engine holder 32 is covered by an engine cover 43.

A drive shaft housing 44 is disposed to the lower portion of the engine holder 32, and a shaft pipe 45 is arranged in the drive shaft housing 44. A drive shaft 42 extends downward in the shaft pipe 45 to drive a propeller 47 through the operation of a bevel gear and a propeller shaft, both not shown, disposed in a gear case 46 formed at the lower portion of the drive shaft housing 44.

The outboard motor 31 is provided with a water-cooling type engine cooling device 48, and the engine cooling device 48 is provided with a water pump 49 disposed at the lower portion of the drive shaft 42 and a water pipe 50 extending from the water pump 49 to the engine 33. The engine cooling device 48 is adapted to pump up water such as sea water by the water pump 49 as a cooling water which is then supplied to the respective components of the engine 33 through the water pipe 50. In such structure, a portion of the cooling water is over-flowed into the shaft pipe 45 above the water pump 49 so as not to suck air in the shaft pipe 50. A hole 51 is formed to the side portion of the shaft pipe 45 so as to communicate the interior of the shaft pipe 45 with the external portion of the outboard motor 31 to treat with a case where an inner pressure of the shaft pipe 45 increases, and the cooling water in the shaft pipe 45 over-flowed through the hole 51 is discharged outside the outboard motor.

A seal member 52 is disposed to the upper end portion of the shaft pipe 45, i.e. a mating surface portion of the upper surface of the drive shaft housing 44 and the lower surface of the oil pan 38, and another seal member 53 is also disposed to a mating surface portion of the upper surface of the oil pan 38 and the lower surface of the crank case 36 of the engine 33.

Further, with reference to FIGS. 1 and 2, the outboard motor 31 is mounted to a transom 54*a* of a hull 54 through clamp brackets 55 and steering brackets 56 which are secured to the engine holder 32.

Figure 3:
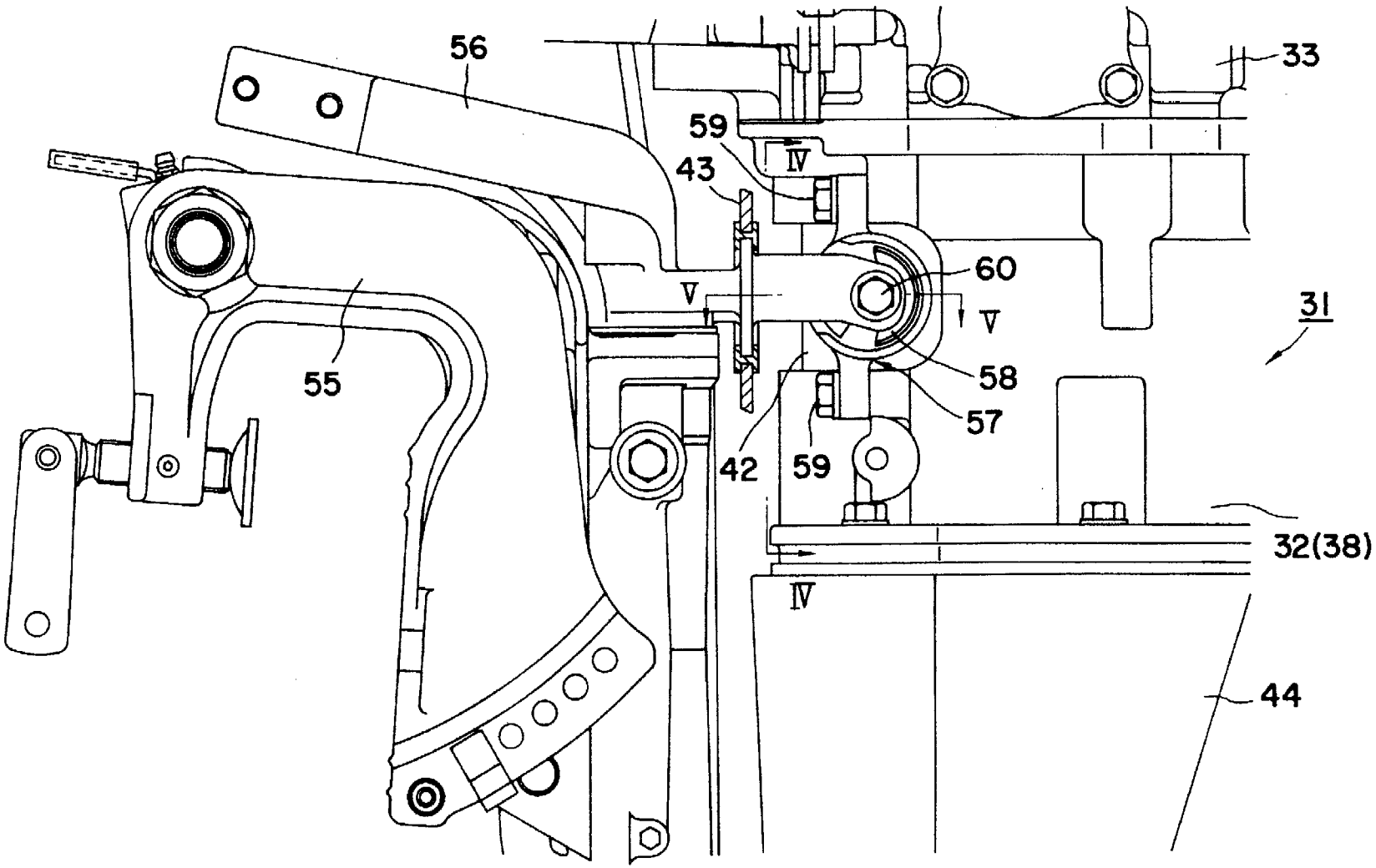
FIG. 3 is an enlarged partial view of the outboard motor of FIG. 1.
Figure 4:
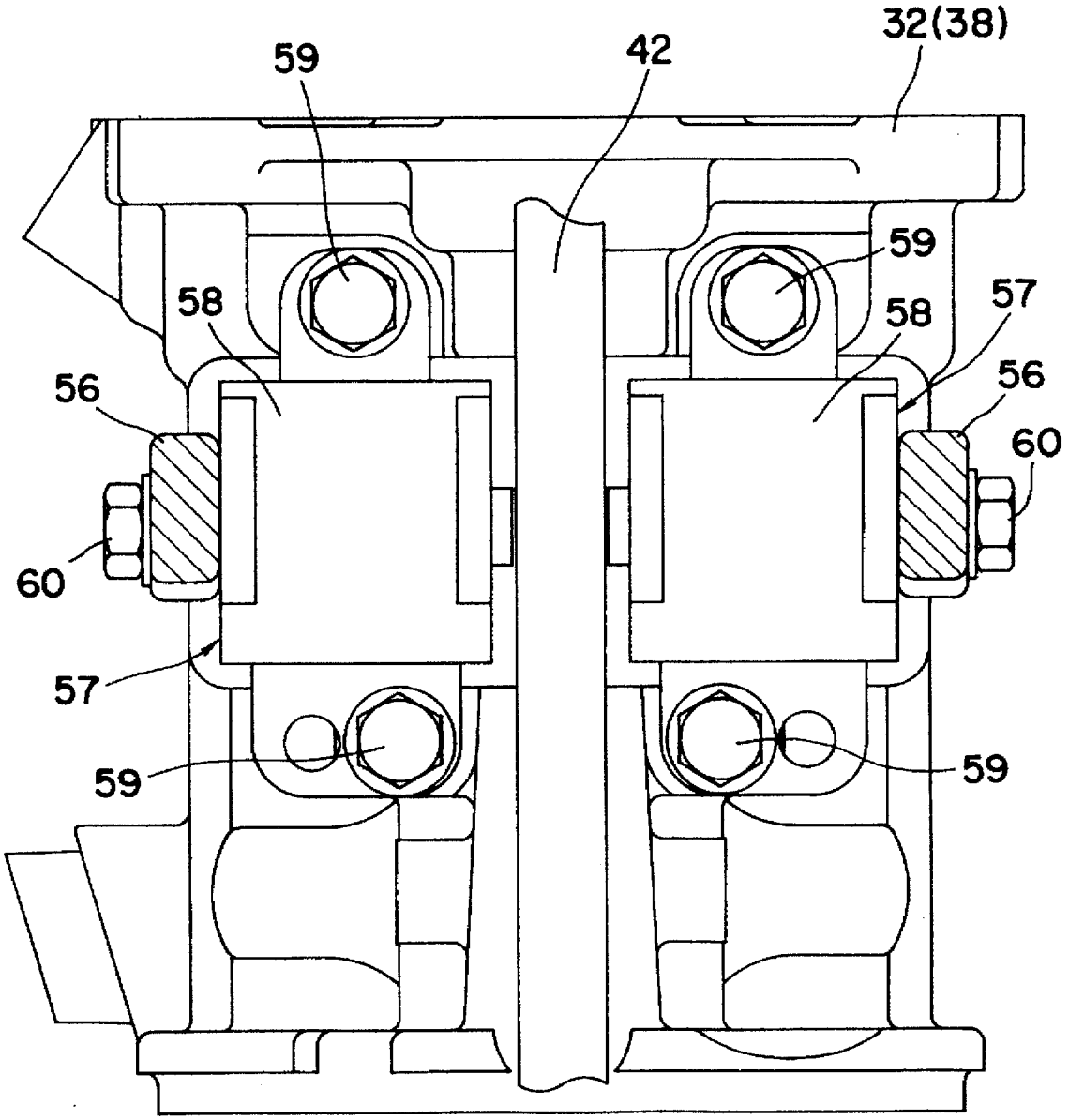
FIG. 4 is a sectional view taken along the line IV—IV in FIG. 3.
Figure 5:
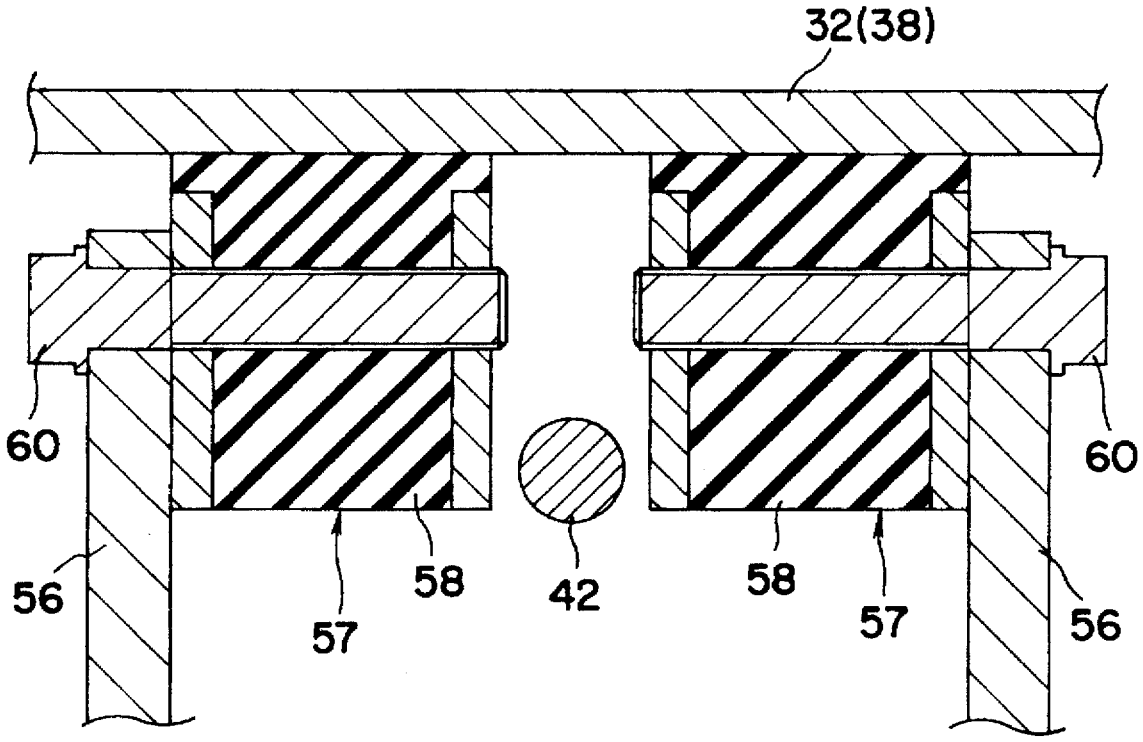
FIG. 5 is a sectional view taken along the line V—V in FIG. 3.
Figure 6:
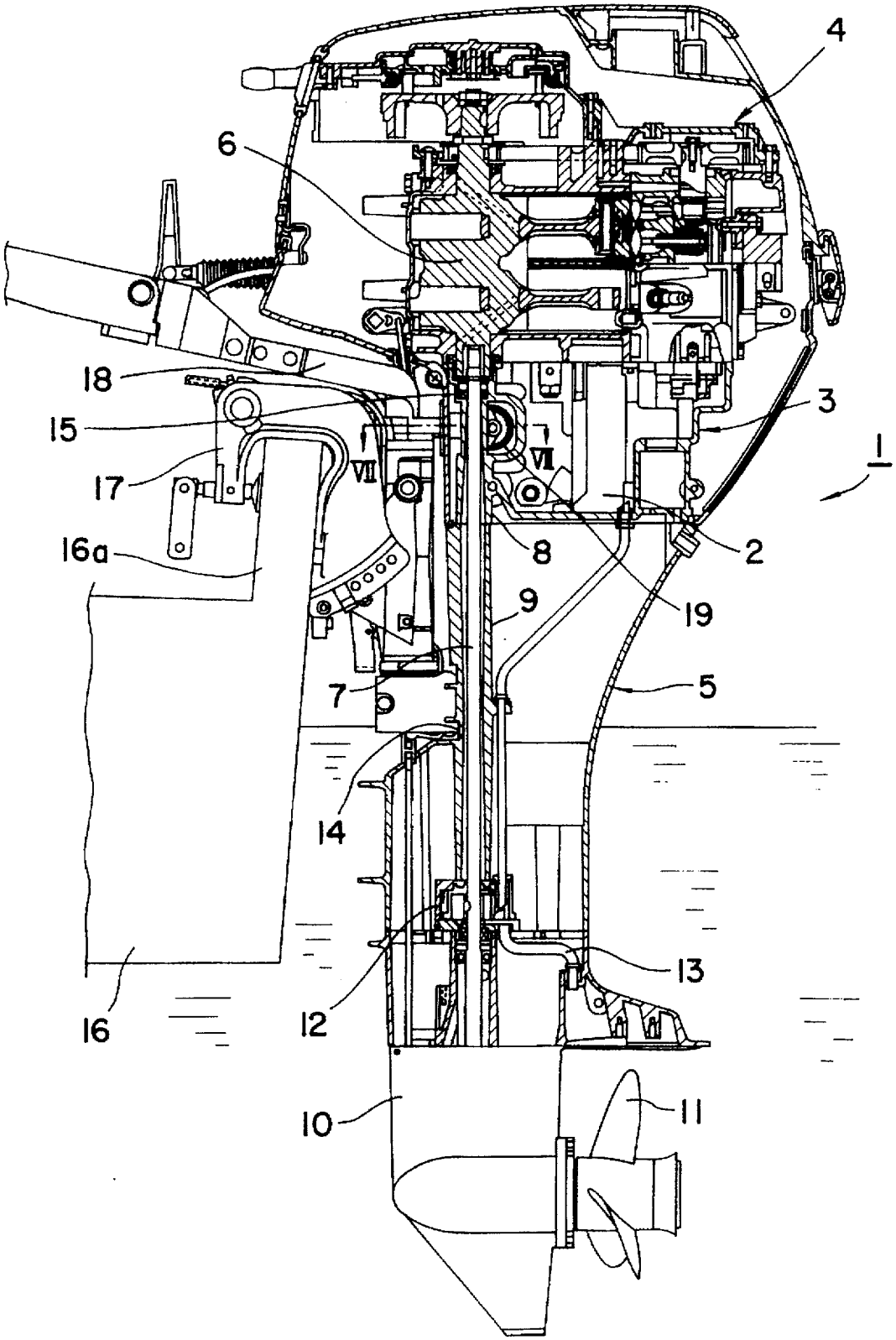
FIG. 6 PRIOR ART
FIG. 6 is an elevational section, similar to that of FIG. 2, of an outboard motor of conventional structure.
Figure 7:
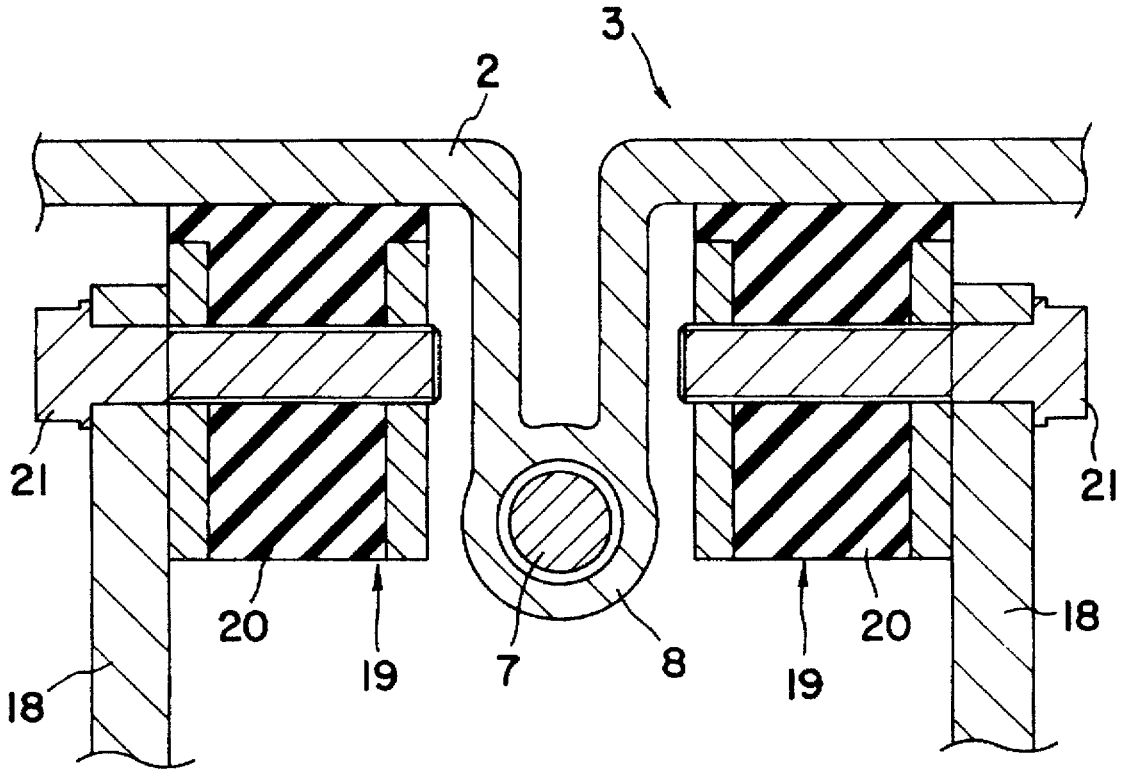
FIG. 7 PRIOR ART
FIG. 7 is a sectional view taken along the line VII—VII in FIG. 6.

Referring to FIGS. 3 and 4, a pair of upper mounts 57 are secured to the wall section of the oil pan 38 of the engine holder 32 through elastic members 58 such as rubber by means of bolts 59. The upper mounts 57 are arranged so as to sandwich the drive shaft 42 therebetween from both the sides thereof so that the drive shaft 42 is exposed between the upper mounts 57, i.e. the seal members 52 and 53. The steering brackets 56 are fixed to the upper mounts 57 by means of bolts 60 or the like.

The outboard motor of the embodiment described above will provide the following functions and effects by way of the operations thereof.

Since the seal member 52 is disposed to the mating surface portion of the upper surface of the drive shaft housing 44 and the lower surface of the oil pan 38 and the seal member 53 is also disposed to the mating surface of the upper surface of the oil pan 38 and the lower surface of the crank case 36, the possibility of invasion of the cooling water in the shaft pipe 45 into the engine 33 can be reduced even if one of these seal members 52 and 53 is damaged in their functions, and hence, the possibility of damaging the engine can be also reduced.

Furthermore, since the sealing can be made at the upper and lower two portions of the drive shaft 42, it becomes not necessary to locate the shaft pipe to a side portion of the oil pan 38, and the drive shaft can be exposed at a portion between the seal members 52 and 53. As a result, it becomes possible to provide a space between the upper mounts 57 having a volume larger than that of the conventional structure, whereby an elastic member 58 having a large volume can be disposed and, hence, the vibration of the engine can be effectively absorbed, reducing the vibration of the engine from being transferred to the hull.

Still furthermore, since it is not necessary to locate the shaft pipe to the side portion of the oil pan 38, the oil pan can be formed relatively freely in shape and the entire weight of the outboard motor can be effectively reduced, which result in cost reducing.

What is claimed is:

1. An outboard motor comprising, in an installed state, an engine holder, an engine located to an upper portion of the engine holder, a drive shaft housing located to a lower portion of the engine holder for housing a drive shaft extending downward from the engine, and an oil pan formed to the engine holder, the oil pan being provided with a wall section to which steering brackets are secured through upper mounts, wherein a first seal member is disposed at a mating surface portion of an upper surface of the drive shaft housing and a lower surface of the oil pan and a second seal member is disposed at a mating surface of an upper surface of the oil pan and a lower surface of the engine to expose the drive shaft between the first and second seal members.

* * * * *